US005735592A

United States Patent [19]

Shu

[11] Patent Number: 5,735,592

[45] Date of Patent: Apr. 7, 1998

[54] PEN SELF-ILLUMINATING WHEN BEING USED

[76] Inventor: Chih-hsien Shu, No. 29, Lane 58, Sec. 1, Lihsing Rd., Sanchung City, Taipei Hsien, Taiwan

[21] Appl. No.: 739,425

[22] Filed: Oct. 29, 1996

[51] Int. Cl.[6] ..... B43K 29/10

[52] U.S. Cl. ..... 362/118; 362/202; 401/195

[58] Field of Search ..... 362/118, 202, 362/800, 808; 401/195

[56] References Cited

U.S. PATENT DOCUMENTS

| | | | |
|---|---|---|---|
| 5,251,112 | 10/1993 | Chen | 362/118 |
| 5,470,164 | 11/1995 | Chen | 401/195 |
| 5,544,967 | 8/1996 | Yao | 401/195 |

*Primary Examiner*—Thomas M. Sember
*Attorney, Agent, or Firm*—Gunn, Lee & Miller, P.C.

[57] ABSTRACT

A pen self-illuminating when being used is disclosed. The pen includes a barrel with an ink reservoir therein. The ink reservoir has a pair of opposed ears extending from a middle portion thereof and a first spring mounted on the pair of opposed ears. A clip is disposed on the barrel and a switch member is disposed on the clip. The switch member comprises a cover, a mercury battery, a conducting strip, a spacer and a lamp. The cover has an electropad and a terminal thereon. The electropad is connected with one electrode of the mercury battery. The lamp is connected between the electropad and the terminal. The spacer is disposed between the mercury battery and the conducting strip. The conducting strip defines a central opening therein, an elastic trip extending from a periphery defining the opening and a contact strip extending upwardly from a periphery thereof. When the pen is being used, the ink reservoir moves upwardly to propel the elastic strip of the conducting strip upwardly to contact with the electrodes of the mercury battery. Thereby, the lamp will be turned on.

7 Claims, 5 Drawing Sheets

PEN SELF-ILLUMINATING WHEN BEING USED

BACKGROUND OF THE INVENTION

1. Field of the Invention

The present invention relates to an illuminated pen, and more particularly to a pen which can provide an illuminated part when being written with.

2. Description of Related Art

Pens are commonly used for writing, however, conventional pens are always designed as various models to meet the needs of various users. Particularly, to attract the children's attention, some of the pens are designed to have some cartoon patterns printed thereon, or a doll disposed on the top of the pen. These designs generally provide a status attraction to the children. Therefore, a dynamic attraction needs to be made for bringing forth new ideas.

The present invention provides a kind of pen self-illuminating when being written with to mitigate and/or obviate the aforementioned problems.

SUMMARY OF THE INVENTION

One aspect of the present invention is to provide a pen which can illuminate part of itself when being written with.

In accordance with one aspect of the present invention, the pen self-illuminating when being used includes a barrel with an ink reservoir received therein. The ink reservoir has a pair of opposed ears extending from a middle portion thereof and a first spring mounted on the pair of ears. A clip is disposed on the barrel. The clip has a collar on a top thereof and defines a hole in the collar for the ink reservoir to extend therethrough. A switch member is disposed on the collar of the clip. The switch member includes a cover, a mercury battery, a conducting strip, a spacer and a lamp. The cover has an electropad and a terminal thereon. The electropad is connected with one electrode of the mercury battery. The lamp is connected between the electropad and the terminal. The spacer is disposed between the mercury battery and the conducting strip. The conducting strip defines a central opening therein, an elastic strip extending from a portion of periphery defining the central opening to be retained by a top end of the ink reservoir and a contact strip extending upwardly from a periphery thereof to be connected with the terminal on the cover.

In accordance with another aspect of the present invention, a switch member enabling the pen to illuminate itself when being writen with comprises a cover, a mercury battery, a conducting strip, a spacer and a lamp. The cover has an electropad and a terminal thereon. The electropad is connected with one electrode of the mercury battery. The lamp is connected between the electropad and the terminal. The spacer is disposed between the mercury battery and the electropad. The conducting strip defines a central opening therein, an elastic strip extending from a portion of periphery defining the central opening to be retained by a top end of the ink reservoir and a contact strip extending upwardly from a periphery thereof to be connected with the terminal on the cover.

Other objects, advantages and novel features of the invention will become more apparent from the following detailed description when taken in conjunction with the accompanying drawings.

DETAILED DESCRIPTION OF PREFERRED EMBODIMENT

Figure 1:
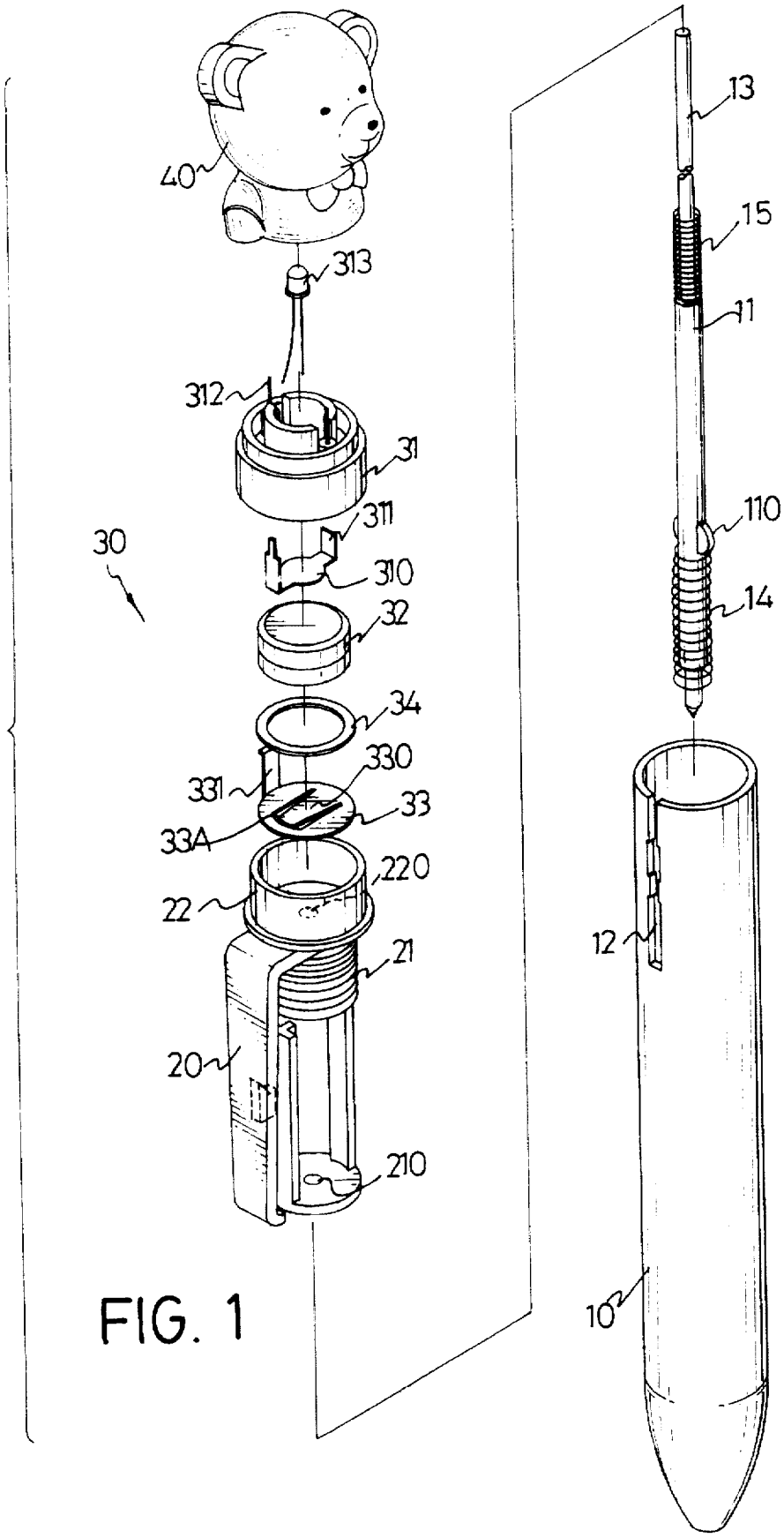
FIG. 1 is an exploded view showing the elements of a self-illuminating pen in accordance with the present invention.

Referring to FIG. 1, a pen which illuminates itself when being written with in accordance with the present invention comprises a barrel 10 with an ink reservoir and nib 11 received therein, a clip 20 attached to the barrel 10, a switch member 30 disposed on the clip 20 and a lamp shade 40 mounted on the switch member 30.

The barrel 10 is tapered to a small diameter at a lower portion so that a bottom end of the ink reservoir and nib 11 can be exactly received therein. The barrel 10 defines a slot 12 at an upper portion of its wall for receiving a tongue 20A of the clip 20 therewithin and has a neck 20B extending into the slot 12 so that the tongue of the clip 20 can be retained when pressed downwardly and a nib 11A of the reservoir 11 can remain protruded from the barrel 10.

Figure 2:
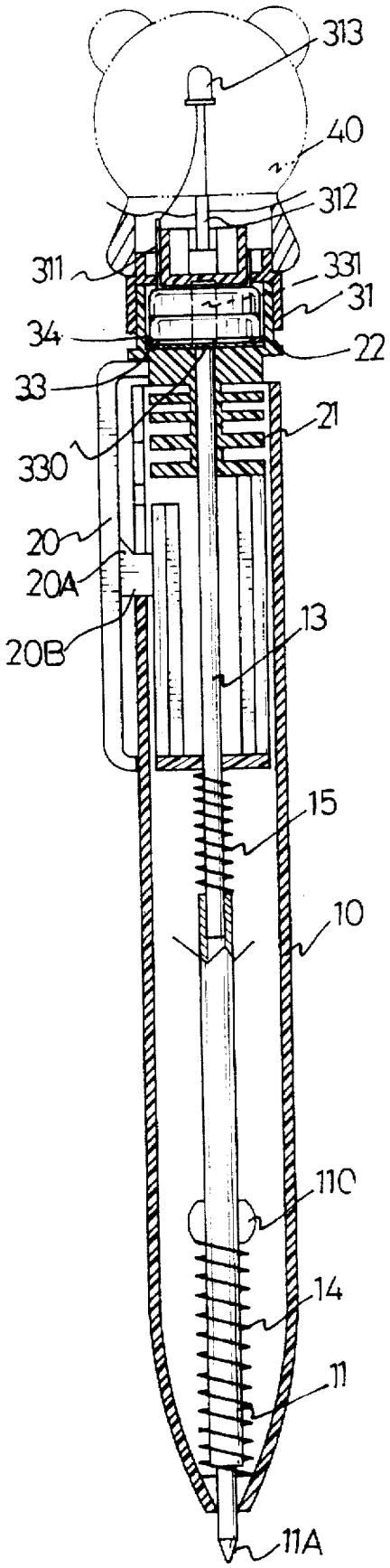
FIG. 2 is a longitudinal sectional view showing the self-illuminating pen in accordance with the present invention.
Figure 3:
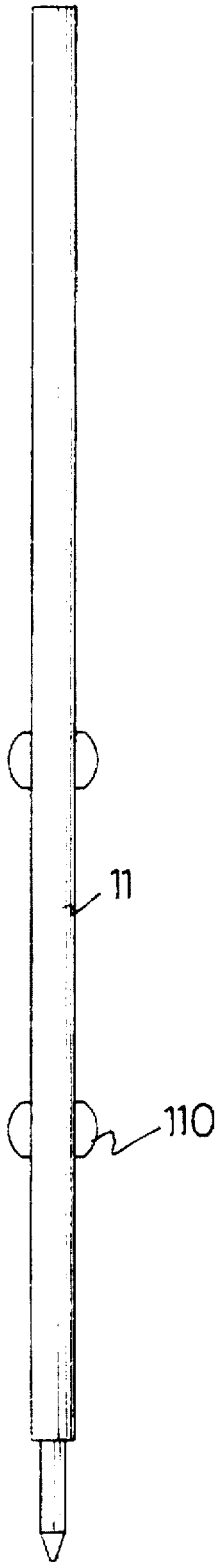
FIG. 3 is schematic view showing a preferred embodiment of an ink reservoir and nib of the self-illuminating pen in accordance with the present invention.
Figure 4:
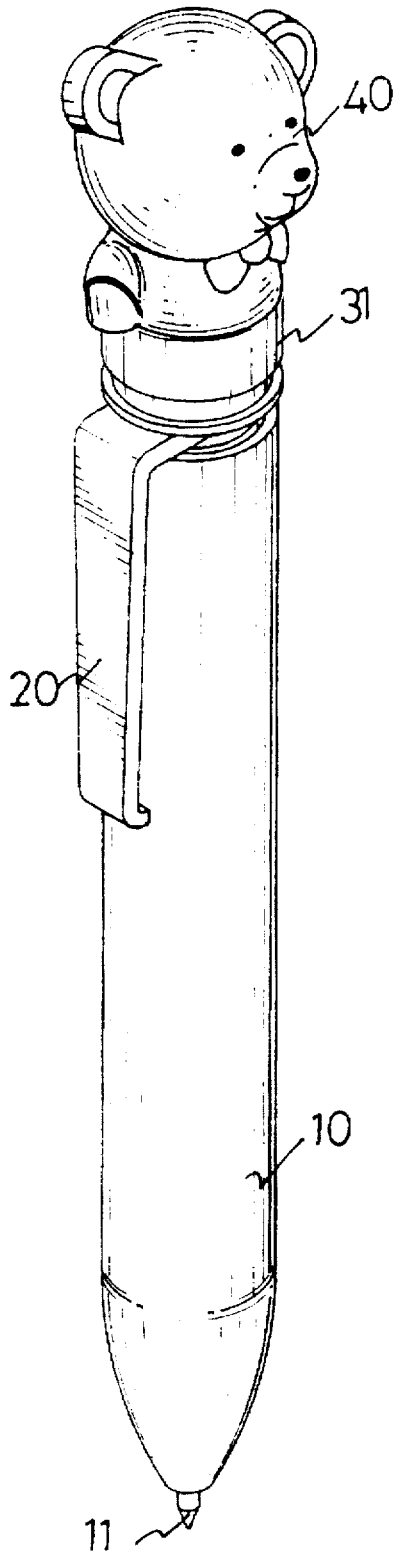
FIG. 4 is a perspective view showing the self-illuminating pen in accordance with the present invention.

Referring to FIG. 2, the ink reservoir 11 has two opposed ears 110 extending from a middle portion thereof and a shaft 13 mounted on a top thereof to retain and trigger the switch member 30. A first spring 15 is mounted on the shaft 13 and a second spring 14 is set beneath the ears 110 on the ink reservoir 11. It is to be noted that the first spring 15 has an elastic coefficient larger than that of the second spring 14. In an alternative embodiment, as shown in FIG. 3, the reservoir 11 has a length extending throughout the barrel 10 and has two pairs of opposed ears 110, 112. Each of the pairs of opposed ears 110, 112 are formed on the reserroir 11 to fixly retain the first spring 15 and the second spring 14, respectively.

The clip 20 has a collar 22 on a top thereof to be received within the switch member 30 and a trunk portion 21 extending downwardly from the collar 22. A first hole 220 is defined in the collar 22 and a second hole 210 is defined at a bottom of the trunk portion 21 so that the shaft 13 can extend through the trunk portion 21 from the collar 22.

Still in FIG. 2, the switch member 30 is disposed on the collar 22 of the clip 20. The switch member 30 includes a cover 31, a mercury battery 32, a conducting strip 33, a spacer 34 and a lamp 313. An electropad 310 configured as a U is mounted at a bottom of the cover 31. The electropad 310 has a pair of arms 311 inserted upwardly into the cover. A terminal 312 extends upwardly from the bottom of the cover 31. The lamp 313 is connected between the terminal 312 and one arm 311 of the electropad 310. The lamp 313 may be a bulb or a light emitting diode (LED) and in this embodiment, an LED is used. Also, the mercury battery 32 and the conducting strip 33 are arranged between the collar 22 and the cover 31 and the spacer 34 is disposed between the bottom of the mercury battery 32 and the conducting strip 33. The electropad 310 is connected with one electrode of the mercury battery 32. The conducting strip 33 defines a U-shaped opening 33A therein and an elastic strip 330 within the U-shaped opening in order to be retained by a top end of the shaft 13. Additionally, a contact strip 331 extends integrally and upwardly from a periphery of the conducting strip 33 to connect with the terminal 312 on the cover 31.

Due to the spacer 34, the other electrode of the mercury battery 32 and the conducting strip 33 are not in contact with each other. When the ink reservoir 11 moves upwardly, the shaft 13 will propel the elastic strip 330 of the conducting strip 33 upwardly to enable the elastic strip 330 to contact with the other electrode of the mercury battery 32. Thereby, the lamp 313 will be turned on. While the ink reservoir 11 moves downwardly, the lamp 313 will be turned off due to the disconnection between the battery 32 and the conducting strip 33.

Furthermore, the lamp shade 40 which transmits light can be made in various forms. In this embodiment, the lamp shade 40 is made to resemble a teddy bear.

The structure of the pen can be apparently seen from the above mentioned description. In the following, the operation of the pen will be depicted with a reference to FIG. 2, 5 and 6.

Figure 5:
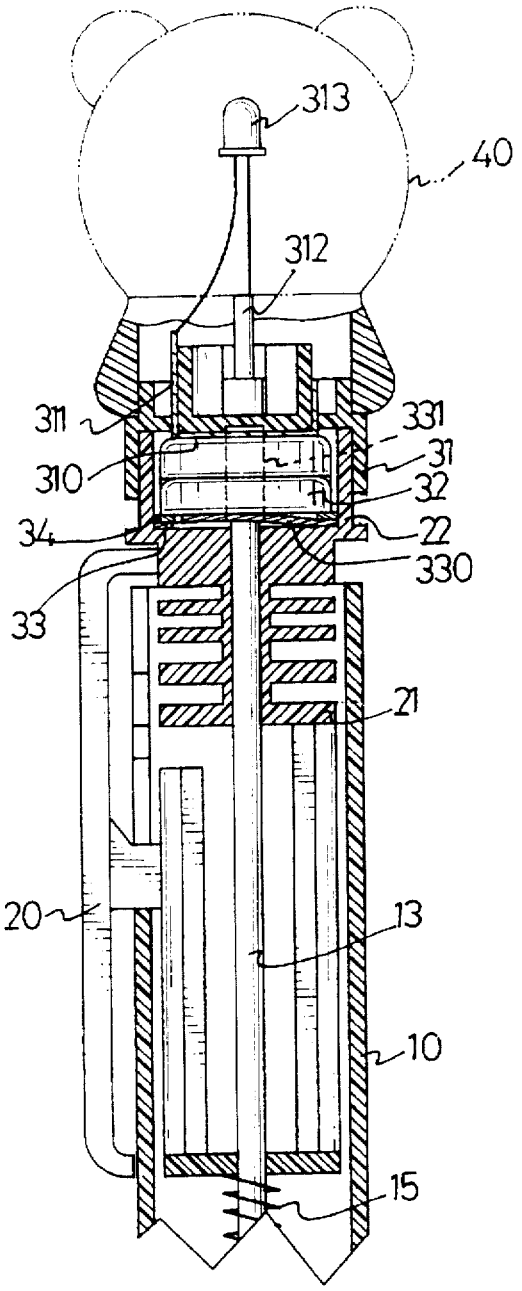
FIG. 5 is a longitudinal sectional view showing a first operation of the self-illuminating pen in accordance with the present invention.
Figure 6:
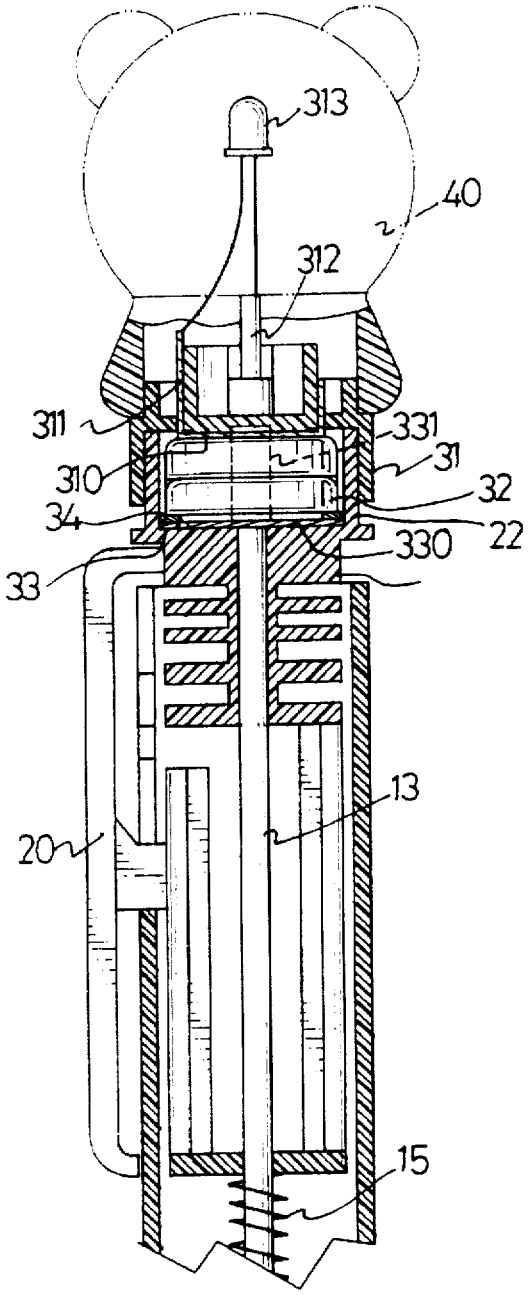
FIG. 6 is a longitudinal sectional view showing a second operation of the self-illuminating pen in accordance with the present invention.

Now referring to FIG. 2, pressing down the clip 20, the nib of the ink reservoir 11 will protrude from the barrel 10 because the second spring 14 will be compressed at first as its elastic coefficient is smaller than that of the first spring 15. When writing with the pen, a force must be applied on the nib so that the ink reservoir 11 tends to move upwardly and the first spring 15 will be compressed. Thereby, the shaft 13 of the ink reservoir 11 will slightly move upward and propel the elastic strip 330 of the conducting strip 33 upward to enable the elastic strip 330 to contact with the other electrode of the mercury battery 32. As a result, the lamp 313 will be turned on, as shown in FIG. 5. When the written action is stopped, the above mentioned force does not exist any more, so the first spring 15 returns to its original state and the ink reservoir 11 slightly moves downward. As a result, the lamp 313 will be turned off due to the disconnection between the battery 32 and the conducting strip 33, as shown in FIG. 6.

In an alternative operation, pressing down the lamp shade 40, the switch member 30 and the clip will be forced to slightly move downward, thereby the conducting strip 33 will retain the top of the shaft 13 downwardly by its elastic strip 330. With a reactive force from the shaft 13, the elastic strip 330 will move upwardly to contact with the electrodes of the mercury battery 32. Sequentially, the lamp 313 will be turned on.

It is to be understood , however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A pen self-illuminating when being used comprising:

a barrel;

an ink reservoir having a pair of opposed ears extending from a middle portion thereof and a first spring mounted on the ears;

a clip disposed on the barrel, said clip having a collar on a top thereof and defining a first hole in the collar for the ink reservoir to extend therethrough; and a switch member disposed on the collar of the clip, said switch member including a cover, a mercury battery, a conducting strip, a spacer and a lamp, said cover having an electropad and a terminal thereon, said electropad being connected with one electrode of the mercury battery, said lamp being connected between the electropad and the terminal, said spacer being disposed between the mercury battery and the conducting strip, said conducting strip defining a central opening therein, an elastic strip extending from a portion of periphery thereof defining the central opening to be retained by a top end of the ink reservoir and a contact strip extending upwardly from a periphery thereof to be connected with the terminal on the cover.

2. A pen self-illuminating when being used as claimed in claim 1, wherein said electropad is configured as a U and is inserted upwardly into the cover.

3. A pen self-illuminating when being used as claimed in claim 1, wherein a second spring is set beneath said pair of opposed ears on the ink reservoir.

4. A pen self-illuminating when being used as claimed in claim 1, wherein said clip further has a trunk portion extending downwardly from the collar, and wherein said trunk portion defines a second hole at a bottom thereof for the ink reservoir to extend therethrough.

5. A pen self-illuminating when being used as claimed in claim 1, wherein a shaft is mounted on said ink reservoir.

6. A switch member enabling a pen to self-illuminate when being used comprising:

a cover, a mercury battery, a conducting strip, a space and a lamp, said cover having an electropad and a terminal thereon, said electropad being connected with one electrode of said mercury battery, said lamp being connected between said electropad and said terminal, said spacer being disposed between said mercury battery and said conducting strip, said conducting strip defining a central opening therein, an elastic strip extending from a portion of a periphery thereof defining said opening to be retained by a top end of an ink reservoir and a contact strip extending upwardly from a periphery of said conducting strip to be connected with said terminal on said cover.

7. A switch member enabling a pen to self-illuminate when being used as claimed in claim 6, wherein said electropad is configured as a U and is inserted upwardly into the cover.

* * * * *